US006439933B1

(12) United States Patent
Moji

(10) Patent No.: US 6,439,933 B1
(45) Date of Patent: Aug. 27, 2002

(54) METHOD OF MOLDING MULTI-POLAR COAXIAL PLUG IN ASSMBLED STATE AND MULTI-POLAR COAXIAL PLUG

(76) Inventor: Eiro Moji, Wing 305, Minami Daira 2-20-2, Mizuho-machi, Nishi Tama-gun, Tokyo (JP)

( * ) Notice: Subject to any disclaimer, the term of this patent is extended or adjusted under 35 U.S.C. 154(b) by 0 days.

(21) Appl. No.: 09/656,747

(22) Filed: Sep. 7, 2000

(30) Foreign Application Priority Data

Feb. 18, 2000 (JP) ..... 12-041683

(51) Int. Cl.[7] ..... H01R 24/04
(52) U.S. Cl. ..... 439/669; 439/668
(58) Field of Search ..... 439/668, 669, 439/736, 218

(56) References Cited

U.S. PATENT DOCUMENTS 2,657,369 A * 10/1953 Ziemianin, Jr. ..... 439/668
3,626,360 A * 12/1971 Cole ..... 439/668
5,290,179 A * 3/1994 Weingartner ..... 439/669
5,820,416 A * 10/1998 Carmichael ..... 439/668
5,924,895 A 7/1999 Moji ..... 439/668
6,126,465 A * 10/2000 Franks, Jr. ..... 439/669 X

FOREIGN PATENT DOCUMENTS

JP 10-199629 7/1988

* cited by examiner

*Primary Examiner*—Brian Sircus
*Assistant Examiner*—Son V. Nguyen
(74) *Attorney, Agent, or Firm*—Browdy and Neimark

(57) ABSTRACT

There is provided a multi-polar coaxial plug molded by the steps of forming a resin molding having a hole in the center to allow a center pin to pass, through holes around the center hole to allow connection terminal pieces to pass and a fit surface on the circumference to allow an outer sleeve to be fitted, and fitting the center pin, the connection terminal pieces and the outer sleeve or the like to the center hole, the through holes and the fit surface of the resin molding to assemble the above members into a unit in a temporarily fixed state, before setting the temporarily fixed members together with the resin molding in a mold for molding with a resin material.

4 Claims, 8 Drawing Sheets

FIG. 1
(PRIOR ART)
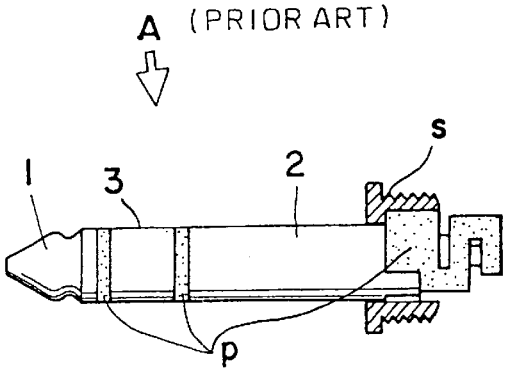
FIG. 4
(PRIOR DEVICE)
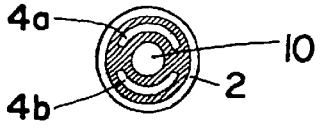
FIG. 2
(PRIOR ART)
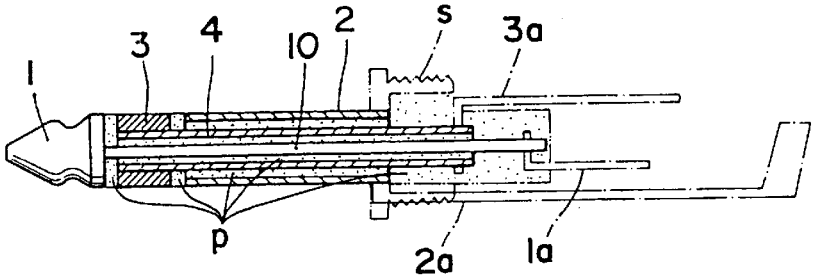
FIG. 3 (PRIOR DEVICE)
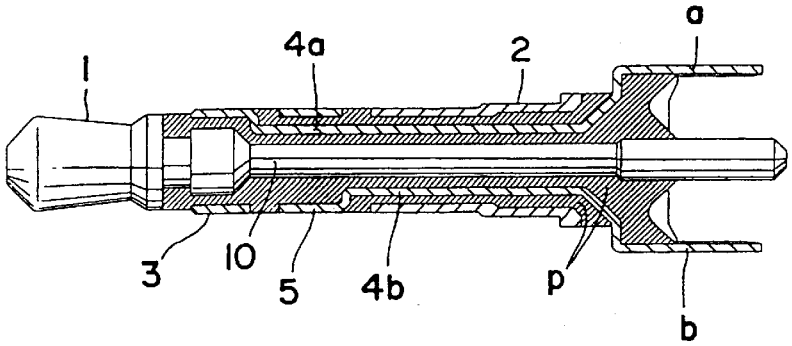
FIG. 5
(PRIOR DEVICE)
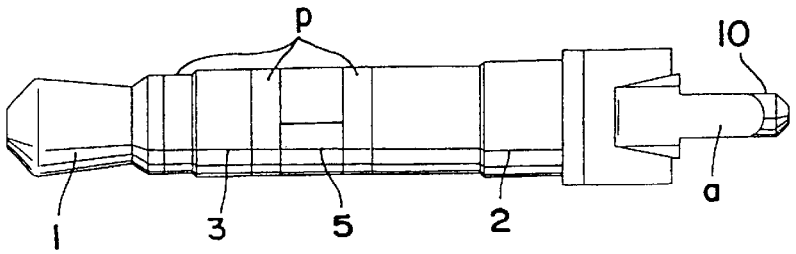

METHOD OF MOLDING MULTI-POLAR COAXIAL PLUG IN ASSMBLED STATE AND MULTI-POLAR COAXIAL PLUG

BACKGROUND OF THE INVENTION

1. Field of the Invention

This invention relates to the improvement on a single-head plug or a multi-polar coaxial plug being of a type, in which the first pole acting as an internal pole is mounted to the end of an axial rod-like body formed by a metal material, and metal rings of the second to nth poles acting as external poles are mounted around the body in axially parallel arrangement.

2. Description of the Prior Art

The multi-polar coaxial plug of the above type, more specifically, a triple-polar coaxial plug is assembled as follows. As shown in FIGS. 1 and 2, for instance, a rearward-extending center pin 10 formed by a metal material is mounted to the axial center of the rear end of a head 1 formed by a metal material acting as the first pole. An outer sleeve 2 formed by a metal material acting as the second pole is fitted to the circumference of the center pin 10 in coaxial arrangement. A metal ring 3 setting up the third pole is inserted between the outer sleeve 2 and the head 1. An intermediate sleeve 4 formed by a metal material and smaller in diameter than the outer sleeve 2 is inserted between the inner surface of the outer sleeve 2 and the outer surface of the center pin 10 in coaxial arrangement relative to the center pin 10. The front end of the intermediate sleeve is united or connected integrally with the above metal ring 3 setting up the third pole, and a connection screw s separately molded with a resin material for screwing a knob is mounted to the rear end of the above outer sleeve 2 setting up the second pole. Then, the above members are set in a mold while being kept in predetermined positions. Subsequently, a resin material p serving as an insulating material is injected into the mold to allow the insulation of the internal pole acting as the first pole from the metal ring 3 setting up the third pole and the earth pole and also to mold the above members as one united body with the resin material p, providing the triple-polar coaxial plug as shown in FIG. 1. Then, connection lug pieces 1*a*, 2*a*, 3*a* are mounted to the triple-polar coaxial plug for connection to a cord, as shown by a chain line in FIG. 2. In use, the cord is connected to these connection lug pieces 1*a*, 2*a*, 3*a* by soldering.

In the case of providing more poles for the multi-polar coaxial plug of the above type, that is, making an attempt to assemble a quadruple-polar coaxial plug by providing one more pole for the above triple-polar coaxial plug, another intermediate sleeve is required, in addition to the intermediate sleeve 4 inserted between the center pin 10 and the outer sleeve 2. In this case, there is the need for insertion of another intermediate sleeve between the above intermediate sleeve 4 and the center pin 10 or between the above intermediate sleeve 4 and the outer sleeve 2 for uniting or connecting integrally the front ends of these intermediate sleeves with the metal ring 3 acting as the third pole and one more metal ring required for setting up the fourth pole. Thus, since two intermediate sleeves are placed in the shape of a double shaft between the outer surface of the center pin 10 and the outer sleeve 2, the flow path for the resin material p when injected is limited to degrade the flow of the injected resin material p, resulting in a problem of making it hard to perform molding with the resin material.

In view of the above circumstances, the applicants of the present invention have developed a means of assembling a multi-polar coaxial plug as shown in FIG. 5 by the steps of forming connection terminal pieces 4*a*, 4*b* of such a shape as the intermediate sleeve 4 united or connected integrally with the metal ring 3 setting up the third pole in the above triple-polar coaxial plug is divided into a plurality of parts in a circumferential direction, placing these connection terminal pieces 4*a*, 4*b* around the center pin 10 in coaxial arrangement as shown in FIG. 4 to unite or connect integrally the metal ring 3 setting up the third pole, a metal ring 5 setting up the fourth pole and a metal ring (not shown) setting up the nth pole (not shown) with the ends of the connection terminal pieces and also to connect the rear ends of the connection terminal pieces 4*a*, 4*b* of the divided intermediate sleeve shape with a core line of a cord by soldering, then mounting these connection terminal pieces 4*a*, 4*b* . . . between the outer surface of the center pin 10 and the inner surface of the outer sleeve 2 in ring-shaped arrangement at predetermined intervals in the circumferential direction as seen from the longitudinal direction, then setting these members in a mold while keeping these members in this state, and injecting the resin material p into the mold to assemble the multi-polar coaxial plug. This means has been applied as Japanese Patent application No. 11-151392.

When more poles are provided for the multi-polar coaxial plug by means of adapting the intermediate sleeve, which is smaller in diameter than the outer sleeve fitted to the circumference of the center pin extending from the rear end of the head, for the connection terminal piece connected to the metal ring mounted between the front face of the outer sleeve and the head in the manner of inserting the intermediate sleeve between the outer surface of the center pin and the inner surface of the outer sleeve in coaxial arrangement relative to the metal ring mounted between the rear face of the head and the front face of the outer sleeve, the following problem is caused. That is, since the plug is limited as to the outer diameter, and the center pin is also limited as to the outer diameter, the intermediate sleeve mounted in multiple arrangement between the outer sleeve and the center pin narrows the flow path for the resin material in excess to thereby make the molding with the resin material difficult.

On the other hand, when more poles are provided by means of mounting the connection terminal pieces, which are connected to the metal rings required for providing more poles, around the center pin in ring-shaped arrangement as seen from the longitudinal direction in the manner of forming these connection terminal pieces to have such a shape as the intermediate sleeve is divided into a plurality of parts in the circumferential direction, only the substantially single intermediate sleeve mounted between the center pin and the outer sleeve makes it possible to increase the poles up to desired number such as four, five and six poles, and as a result, molding by pressure injection of the resin material may be carried out without difficulties. However, the above means involves such a problem as the connection terminal pieces of such the circumferentially divided intermediate sleeve shape are hard to be set in the mold while being kept at their predetermined positions.

SUMMARY OF THE INVENTION

The present invention is provided for dissolving the above problems with the conventional means, and its object is to provide a novel method for facilitating molding by pressure injection of a resin material by, while providing more poles by means of mounting connection terminal pieces connected to metal rings acting as incremental poles in ring-shaped arrangement as seen from the longitudinal direction in the manner of forming these connection terminal pieces to have such a shape as an intermediate sleeve is divided into a plurality of parts in the circumferential direction, allowing a plurality of connection terminal pieces of such the circumferentially divided intermediate sleeve shape to be set in a mold in such a state that the connection terminal pieces are temporarily fixed as being held at predetermined positions together with a center pin and an outer sleeve or the like.

According to the present invention, as a means of attaining the above object, there is provided a method of molding a multi-polar coaxial plug in an assembled state. That is, in a multi-polar coaxial plug molded with a resin material after being assembled by the steps of mounting metal rings setting up the third to nth poles in longitudinally parallel arrangement between the rear face of a front end head acting as the first pole and the front face of an outer sleeve fitted in coaxial arrangement to the circumference of a center pin extending from the rear end of the head to set up the second pole, forming connection terminal pieces united or connected integrally with the metal rings to have such a shape as an intermediate sleeve mounted in coaxial arrangement between the outer surface of the center pin and the inner surface of the outer sleeve is divided into parts in the circumferential direction, and then mounting these connection terminal pieces between the center pin and the outer sleeve in ring-shaped arrangement at predetermined intervals in the circumferential direction, the method of molding the multi-polar coaxial plug in an assembled state comprises the steps of forming a resin molding having a hole in the center to allow the center pin to pass, through holes around the center hole to allow the connection terminal pieces to pass and a fit surface on the circumference to allow the outer sleeve to be fitted, and fitting the center pin, the plurality of connection terminal pieces and the outer sleeve or the like to the center hole, the through holes and the fit surface of the resin molding to assemble the above members into a unit in a temporarily fixed state, before setting the above temporarily fixed members together with the resin molding in a mold for molding with the resin material. There is further provided a multi-polar coaxial plug, which comprises a resin molding formed by a resin material and having a hole in the axial center to allow a center pin extending from the rear end of a head to pass, a fit surface on the circumference to allow an outer sleeve to be fitted, and through holes in radially intermediate portions between the fit surface and the center hole in ring-shaped arrangement at predetermined intervals in the circumferential direction as seen from the rear face to allow a plurality of connection terminal pieces connected to the plurality of metal rings mounted between the front end face of the outer sleeve and the rear end face of the head to pass, wherein the center pin extending from the head, the outer sleeve and the connection terminal pieces are assembled into a unit in the temporarily fixed state by fitting the rear end of the center pin, the inner surface of the outer sleeve and the rear ends of the connection terminal pieces to the resin molding, before being set together with the resin molding in the mold for integral molding with a resin material.

The multi-polar coaxial plug according to the present invention is similar to the prior art already applied by the applicants of the present invention in that the nipple-shaped head united or connected integrally with the center pin at the rear end, the outer sleeve fitted to the circumference of the center pin in coaxial arrangement, the plurality of metal rings fitted to the circumference of the center pin in longitudinally parallel and coaxial arrangement at positions between the front face of the outer sleeve and the rear face of the head and the plurality of connection terminal pieces united or connected integrally with the metal rings are made of the metal material, and that the multi-polar coaxial plug is assembled by setting these members in a mold cavity such that these members occupy predetermined positions, before pressure-injection of a molten resin material through a cross gate provided in the mold for integral molding.

However, according to the present invention, the head, the center pin extending from the head, the outer sleeve, the metal rings and the connection terminal pieces united or integrally connected with the metal rings are assembled into a unit in a temporarily fixed state in the manner of fitting these members to the separately-formed resin molding, before being set in the mold. Then, the temporarily fixed members are set in the mold together with the resin molding to start molding of the temporarily fixed members inclusively of the resin molding by pressure injection of the resin material.

The resin molding for use in the present invention takes the axial rod-like shape to allow the inner surface of the outer sleeve to be fitted to the circumference, and is formed by the resin material in advance so as to have the hole in the longitudinal center to allow the rear end of the center pin extending from the head to pass and the longitudinal through holes in the radially intermediate portions between the center hole and the outer surface of the resin molding in ring-shaped arrangement at predetermined intervals in the circumferential direction as seen from the longitudinal direction to allow the rear ends of the connection terminal pieces to individually pass.

The center pin extending from the rear end of the head and the connection terminal pieces connected to the metal rings preliminarily fitted to the center pin are assembled into a unit in the temporarily fixed state by fitting the rear end of the center pin and the rear ends of the connection terminal pieces into the center hole and the through holes of the resin molding respectively, before being set in the mold.

In this place, the inner surface of the cavity defined in the drag of the mold makes it necessary to have slight step portions, which come in contact with the metal rings fitted in longitudinally parallel arrangement to the circumference of the center pin for axial location of the metal rings, within the range of tolerance for the standard size of the target multi-polar coaxial plug for assembling.

Another step portion coming in contact with a flange portion formed on the outer surface of the outer sleeve for axial location of the outer sleeve is also required for the inner surface of the cavity defined in the drag of the mold, as a matter of course. The inner surface of the outer sleeve also has a step portion for regulating the axial fit depth as of the time when the outer sleeve is fitted to the circumference of the resin molding.

The resin molding is structured to have a flow path, which allows the pressure-injected resin material to flow, between the inner surface of the outer sleeve and the resin molding when the resin molding is fitted in a plugged state to the cavity of the outer sleeve. A cut-out portion axially formed on the outer surface of the resin material is only needed for the flow path.

The through holes formed in the resin molding have different sectional shapes so as to vary the circumferential width, for instance, for preventing the wrong pole from being selected when a core of the cord is connected to the connection terminal piece projecting from the corresponding through hole by soldering. Further, the rear end of each connection terminal piece to be inserted into the corresponding through hole also has a shape suited for only the corresponding through hole.

Further, the resin molding has a reference polarity mark on its rear end side projecting from the outer sleeve rearward for easily identifying that the connection terminal piece projecting from the above corresponding through hole is connected to which of the metal rings mounted in longitudinally parallel arrangement.

The cope of the mold is formed to have the inner surface, which comes in contact with the rear ends of the center pin, the resin molding and the outer sleeve or the like for axial location of these members, when the cope is brought into contact with the drag after the resin molding incorporated with the members in the temporarily fixed state is set in the drag.

According to the multi-polar coaxial plug molded in the assembled state as described above, the connection terminal pieces united or connected integrally with the incremental metal rings mounted between the head and the outer sleeve for providing more poles for the multi-polar coaxial head, as needed, are formed to have the shape as the intermediate sleeve is divided into parts in the circumferential direction. Then, the connection terminal pieces of the above shape are incorporated in the preliminarily formed resin molding in the temporarily fixed state together with the center pin and the outer sleeve, before being set in the mold for molding with the resin material. As a result, the operation of setting the members in the mold is substantially facilitated, and besides, the members may be set with accuracy.

On the other hand, in the case of providing more poles by mounting an external pole of large diameter to the circumference of the outer sleeve, there is the need for mounting the external pole of large diameter after the multi-polar coaxial plug is molded on condition that a fit portion allowing the external pole of large diameter to be fitted is formed by the resin material, which is used for molding, to the circumference of the outer sleeve fitted to the circumference of the resin molding before the members incorporated in the resin molding are set in the mold for molding.

BRIEF DESCRIPTION OF THE DRAWINGS

The foregoing and other objects and features of the invention will become apparent from the following description of preferred embodiments of the invention with reference to the accompanying drawings, in which:

FIG. 1 is a partially broken side view showing a triple-polar coaxial plug in the prior art;

FIG. 2 is a longitudinal sectional side view showing the above plug;

FIG. 3 is a longitudinal sectional side view showing a quadruple-polar coaxial plug in the prior art;

FIG. 4 is a longitudinal sectional rear view showing the above plug;

FIG. 5 is a side view showing the above plug;

DESCRIPTION OF THE PREFERRED EMBODIMENTS

Figure 6:
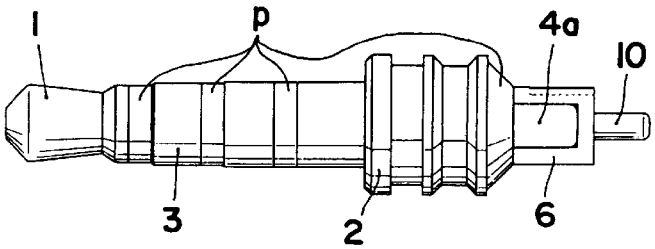
FIG. 6 is a side view showing a quadruple-polar coaxial plug assembled according to a means of the present invention.
Figure 7:
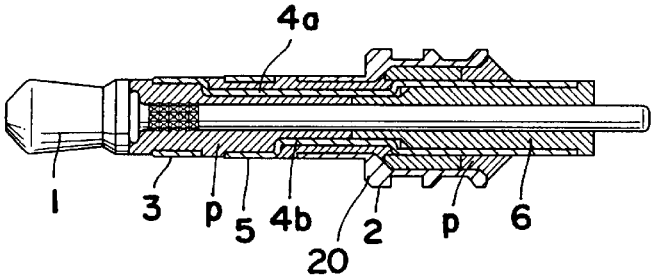
FIG. 7 is a longitudinal sectional side view showing the above plug.

FIG. 6 is a side view showing a quadruple-polar coaxial plug molded in an assembled state according to a means of the present invention, and FIG. 7 is a longitudinal sectional side view showing the above plug. In FIGS. 6 and 7, reference numeral 1 denotes a head acting as the first pole, 10 is a center pin projecting from the axial core of the rear end face of the head 1, 2 is an outer sleeve fitted to the circumference of the center pin 10 in coaxial arrangement to act as the second pole, 3 is a metal ring fitted to the circumference of the center pin 10 in axial arrangement at a position between the front end of the outer sleeve 2 and the rear end of the head 1 to set up the third pole, 4*a* is a connection terminal piece connected to the metal ring 3, 5 is a metal ring placed at the rear of the metal ring 3 in parallel arrangement to set up the fourth pole, 4*b* is a connection terminal piece connected to the metal ring 5 setting up the fourth pole, 6 is a resin molding for assembling the head 1, the center pin 10, the outer sleeve 2, the metal rings 3, 5 and the connection terminal pieces 4*a*, 4*b* or the like into a unit in a temporarily fixed state, and p is a resin material.

Figure 8:
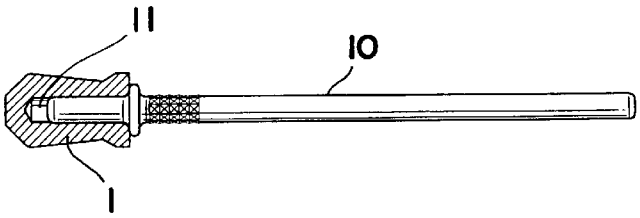
FIG. 8 is a partially broken side view showing a head and a center pin of the above plug.
Figure 10:
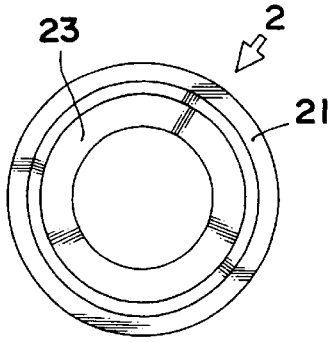
FIG. 10 is a rear view showing the outer sleeve of the above plug.
Figure 9:
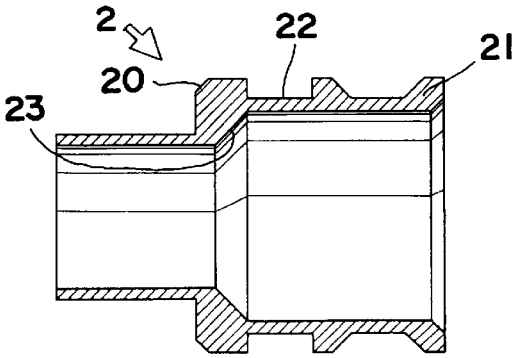
FIG. 9 is a longitudinal sectional side view showing an outer sleeve of the above plug.

The head 1 is formed by a metal material in the shape of a nipple, and a fit hole 11 open to the rear end face is provided in the axial center of the head as shown in FIG. 8. The head 1 is connected integrally with the center pin 10 formed by a metal material by pressing the front end of the center pin 10 into the fit hole 11. The metal material is cut to form the head 1 and the center pin 10 as one united body in some cases.

The outer sleeve 2 formed in a cylindrical shape by a metal material has a circumferentially expanding flange portion 20 at a longitudinally intermediate portion of the outer surface, and the latter half bordering on the flange portion 20 is formed into an enlarged diameter portion 21 so that the fit depth of the outer sleeve 2 relative to the resin molding 6 may be regulated by the enlarged diameter portion 21 when the outer sleeve 2 is fitted to the circumference of the resin molding 6. Further, a plurality of concave grooves 22, 22 are formed on the outer surface of the enlarged diameter portion 21 in circumferentially continuous arrangement. A contact surface 23 is formed on the inner side of the enlarged diameter portion 21 to regulate the fit depth of the resin molding 6.

Figure 11:
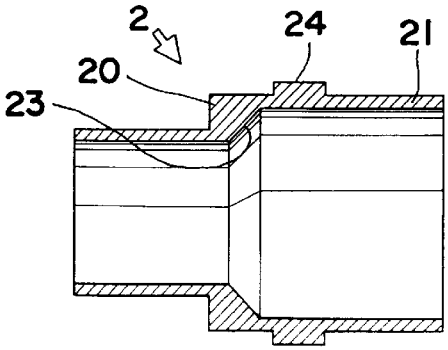
FIG. 11 is a longitudinal sectional side view showing another embodiment of the outer sleeve of the above plug.
Figure 12:
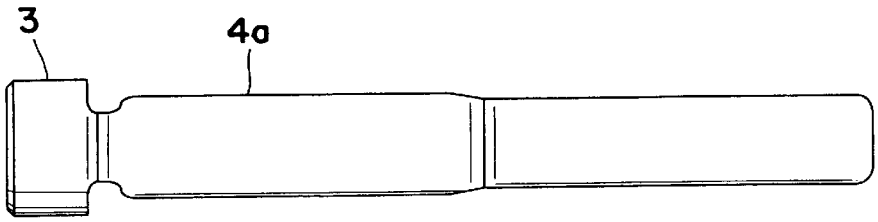
FIG. 12 is a plan view showing a third-polar metal ring and a connection terminal piece connected thereto in the above plug.
Figure 13:
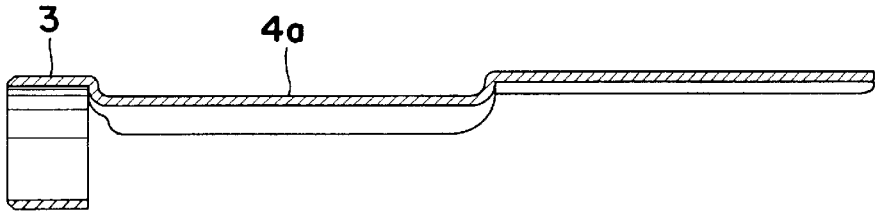
FIG. 13 is a longitudinal sectional side view showing the metal ring and the connection terminal piece of FIG. 12 in the above plug.
Figure 14:
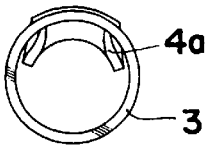
FIG. 14 is a front view showing the metal ring and the connection terminal piece of FIG. 12.

FIG. 11 shows an embodiment applied to the case of additionally mounting a cylindrically external pole of large diameter to the circumference of the outer sleeve 2. The outer sleeve according to this embodiment is formed to have only a single projection 24 on the outer surface in circumferentially continuous arrangement without providing the concave grooves 22, 22.

Figure 15:
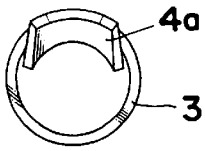
FIG. 15 is a rear view showing the metal ring and the connection terminal piece of FIG. 12.

As shown in FIGS. 12 to 15, the metal ring 3 setting up the third external pole is united with the connection terminal piece 4*a* such that the connection terminal piece extends from a part of the peripheral edge of the outer sleeve rearward. As shown in FIG. 15, the connection terminal piece 4*a* has a semi-circular band-like shape as seen from the rear face.

Figure 16:
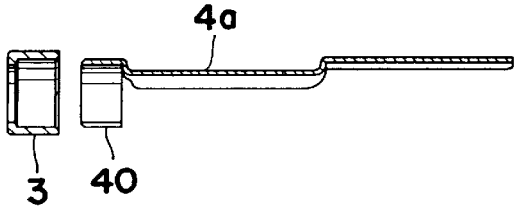
FIG. 16 is a longitudinal sectional side view showing another embodiment of the metal ring and the connection terminal piece of FIG. 12.
Figure 19:
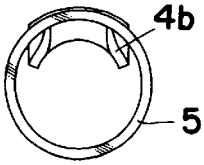
FIG. 19 is a front view showing the metal ring and the connection terminal piece of FIG. 17.
Figure 17:
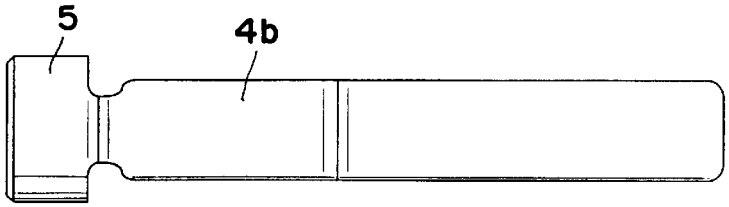
FIG. 17 is a plan view showing a fourth-polar metal ring and a connection terminal piece connected thereto in the above plug.
Figure 20:
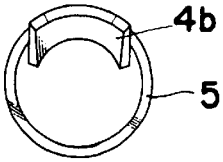
FIG. 20 is a rear view showing the metal ring and the connection terminal piece of FIG. 17.
Figure 18:
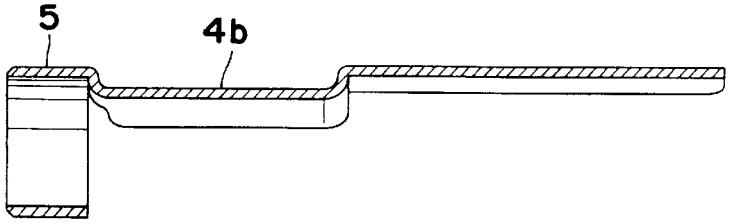
FIG. 18 is a longitudinal sectional side view showing the metal ring and the connection terminal piece of FIG. 17.

When the metal ring 3 is formed separately from the connection terminal piece 4*a* as shown in FIG. 16, there is the need for connection of the metal ring 3 integrally with the connection terminal piece 4*a* formed by a metal sheet having a spring property by fitting a ring-like portion 40, which is formed by bending a lug piece formed on the front end of the connection terminal piece 4*a*, into the inner side of the metal ring 3 as a means for the convenience of tightening.

As shown in FIGS. 17 to 20, the metal ring 5 setting up the fourth external pole is connected integrally with the connection terminal piece 4*b* having a section of a semi-circularly curved band-like shape, similarly to the above metal ring 3. This connection terminal piece 4*b* has a longitudinal length smaller than that of the connection terminal piece 4*a* connected to the above metal ring 3.

Figure 21:
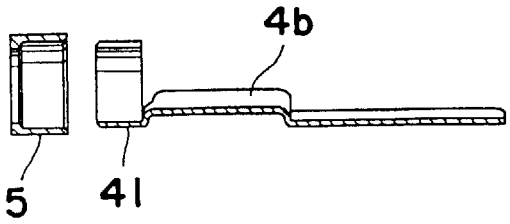
FIG. 21 is a longitudinal sectional side view showing another embodiment of the metal ring and the connection terminal piece of FIG. 17.
Figure 33:
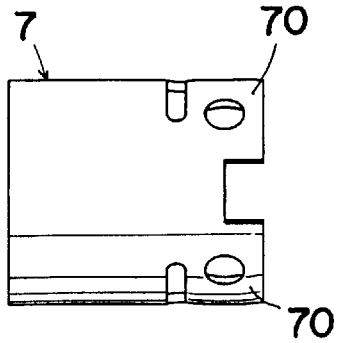
FIG. 33 is a plan view showing an external pole additionally mounted as the fifth pole to the plug of the above embodiment.
Figure 34:
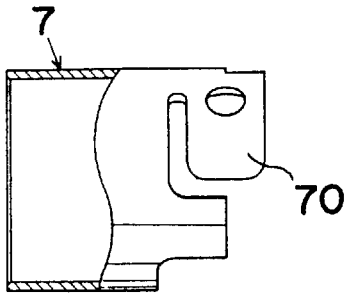
FIG. 34 is a partially broken side view showing the above external pole.
Figure 35:
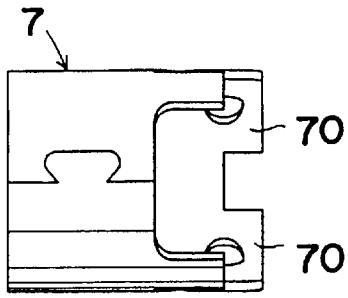
FIG. 35 is a bottom view showing the above external pole.
Figure 36:
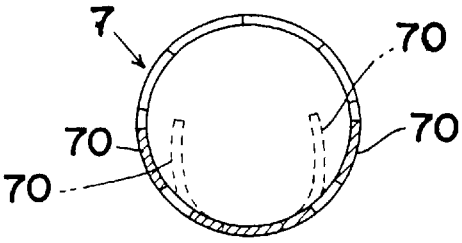
FIG. 36 is a longitudinal sectional rear view showing the above external pole.

When the metal ring 5 is formed separately from the connection terminal piece 4*b* as shown in FIG. 21, there is also the need for connection of the metal ring 5 integrally with the connection terminal piece 4*b* formed by a metal sheet having a spring property by fitting a ring-like portion 41 formed on the front end of the connection terminal piece 4*b* into the metal ring 5.

Figure 26:
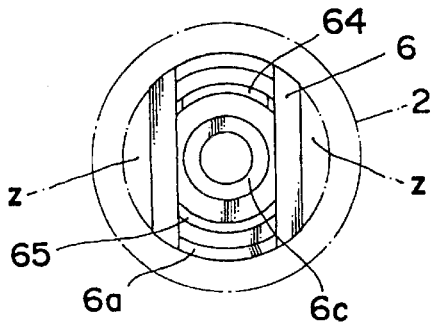
FIG. 26 is a rear view showing the above plug.
Figure 25:
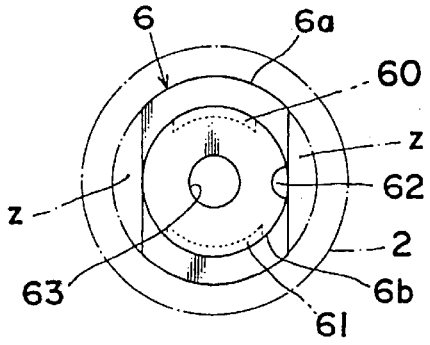
FIG. 25 is a front view showing the above plug.
Figure 22:
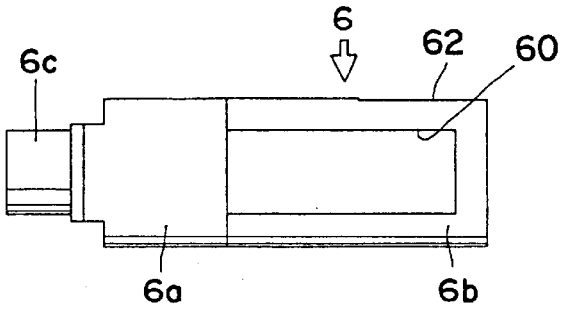
FIG. 22 is a plan view showing a resin molding for the above plug.
Figure 23:
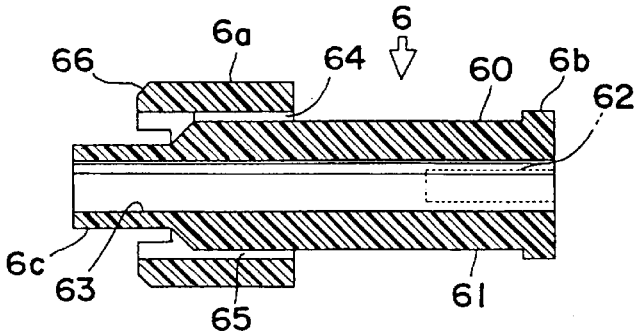
FIG. 23 is a longitudinal sectional side view showing the above plug.
Figure 24:
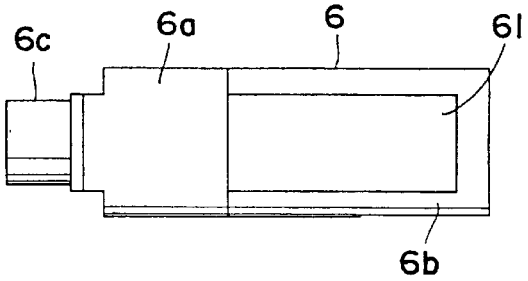
FIG. 24 is a bottom view showing the above plug.

As shown in FIGS. 23 to 26, the resin molding 6 is formed in the shape of a shaft to have an enlarged diameter portion 6*a* on the first half side so that the insertion of the enlarged diameter portion 6*a* into the cavity of the outer sleeve 2 allows the resin molding to be fitted in a plugged state to the outer sleeve. Further, the left and right sides of the enlarged diameter portion are formed as planes by cutting as shown in FIGS. 25 and 26, so that the cut-out portions may be adapted for the flow paths z of the resin material when the resin molding is fitted into the outer sleeve 2.

The second half of the resin molding 6 is formed as a rearward projecting long small-diameter portion 6*b* of such a diameter as the planes formed by cutting the opposite sides of the enlarged diameter portion 6*a* on the front half side are circumscribed. The upper and lower surfaces of the small-diameter portion are provided with shallow concave grooves 60, 61, which allow the rear ends of the above connection terminal pieces 4*a*, 4*b* to be respectively fitted. Further, one of the left and right side surfaces has a polarity mark 62 formed in the shape of a concave groove for identifying the polarity of the connection terminal pieces 4*a*, 4*b*.

The front end of the resin molding 6 is formed as a short shaft portion 6c of a diameter smaller than that of the above small diameter portion 6*b* such that the shaft portion projects from the enlarged diameter portion 6*a* forward.

Reference numeral 63 denotes a hole formed in the axial center of the resin molding 6 so as to extend from the small diameter shaft portion 6*c* at the front end to the small diameter portion 6*b* through the enlarged diameter portion 6*a*.

Reference numerals 64, 65 denote through holes formed in the resin molding 6 so as to allow the rear ends of the above connection terminal pieces 4*a*, 4*b* to pass. These through holes are provided in portions corresponding to the concave grooves 60, 61 formed on the upper and lower surfaces of the above small diameter portion 6*b* so as to extend through the enlarged diameter portion 6*a* longitudinally. The bottom sides of the through holes are formed to be continuous with the bottoms of the above concave grooves 60, 61. As shown in FIG. 26, the through holes 64, 65 have a section of a semi-circular shape similar to the sectional shape of the above connection terminal pieces 4*a*, 4*b* and are different in circumferential width from each other so as to allow only the connection terminal piece 4*a*, 4*b* suited for the width of the corresponding through hole to pass, individually.

Further, the front end of the enlarged diameter portion 6*a* has a fit surface 66 which comes in contact with the contact surface 23 formed on the front end of the inner surface of the enlarged diameter portion 21 of the outer sleeve 2 when the outer sleeve 2 is fitted to the circumference.

Figure 27:
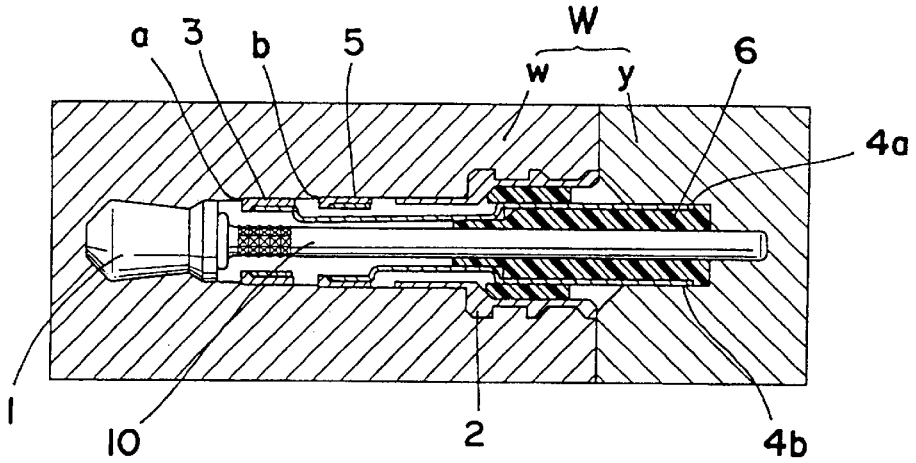
FIG. 27 is a cross-sectional view showing the state in which the members of the above plug are set in a mold after being incorporated into a resin molding.

FIG. 27 is a sectional view showing the state, in which the center pin 10 extending from the head 1, the outer sleeve 2, the metal ring 3, the connection terminal piece 4*a* connected to the metal ring 3, the metal ring 5 and the connection terminal piece 4*b* connected to the metal ring 5 are incorporated into the above resin molding 6 to assemble these members into a unit in a temporarily fixed state, before being set in a mold W together with the resin molding. In FIG. 27, reference character w denotes a drag of the mold W, and y is a cope thereof.

The drag w has step portions a, b, which are within the range of tolerance for the size of a target multi-polar coaxial plug for assembling, on the inner surface of the cavity at positions corresponding to the respective front edges of the metal rings 3, 5. The axial positions of the metal rings 3, 5 connected to the connection terminal pieces 4*a*, 4*b* inserted into the through holes 64, 65 of the resin molding 6 for regulation of the radial positions are regulated by contact of the metal rings 3, 5 with the step portions a, b such that the metal rings occupy the predetermined positions of the mold.

Further, the position of the outer sleeve 2 fitted to the circumference of the resin molding 6 is regulated by contact of the flange portion 20 on the front end side with the step portion c provided on the inner surface of the drag w and also by contact of the rear end face of the outer sleeve with the inner surface of the cope y such that the outer sleeve occupies the predetermined position of the mold.

The positions of the center pin 10 fitted into the center hole 63 of the resin molding 6 and the head connected thereto are regulated by contact of the opposite longitudinal ends with the inner surfaces of the cavities of the drag w and the cope y such that the center pin and the head occupy the predetermined positions of the mold.

Figure 28:
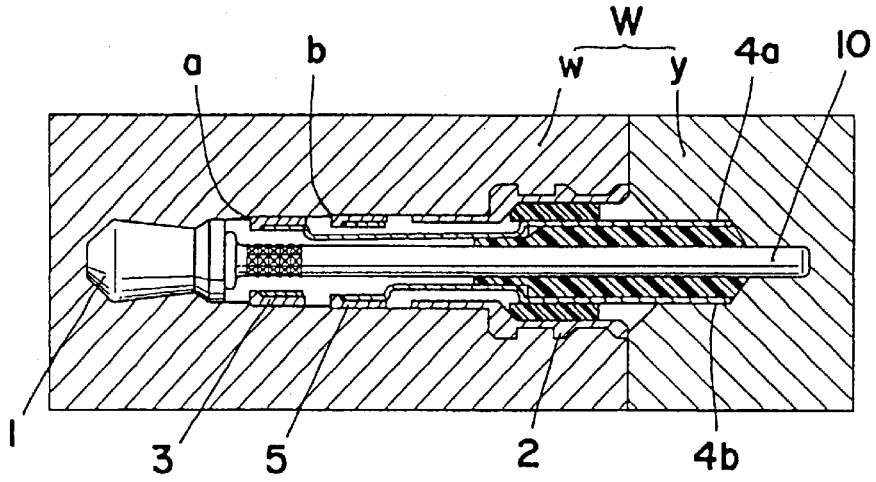
FIG. 28 is a cross-sectional view showing the above state in another embodiment of the above plug.

As shown in FIG. 28, the rear ends of the connection terminal pieces 4*a*, 4*b* may be made longer up to the rear end of the resin molding 6 for regulation of the axial positions by contact of the rear ends of the connection terminal pieces with the inner surface of the cavity of the cope y.

Figure 29:
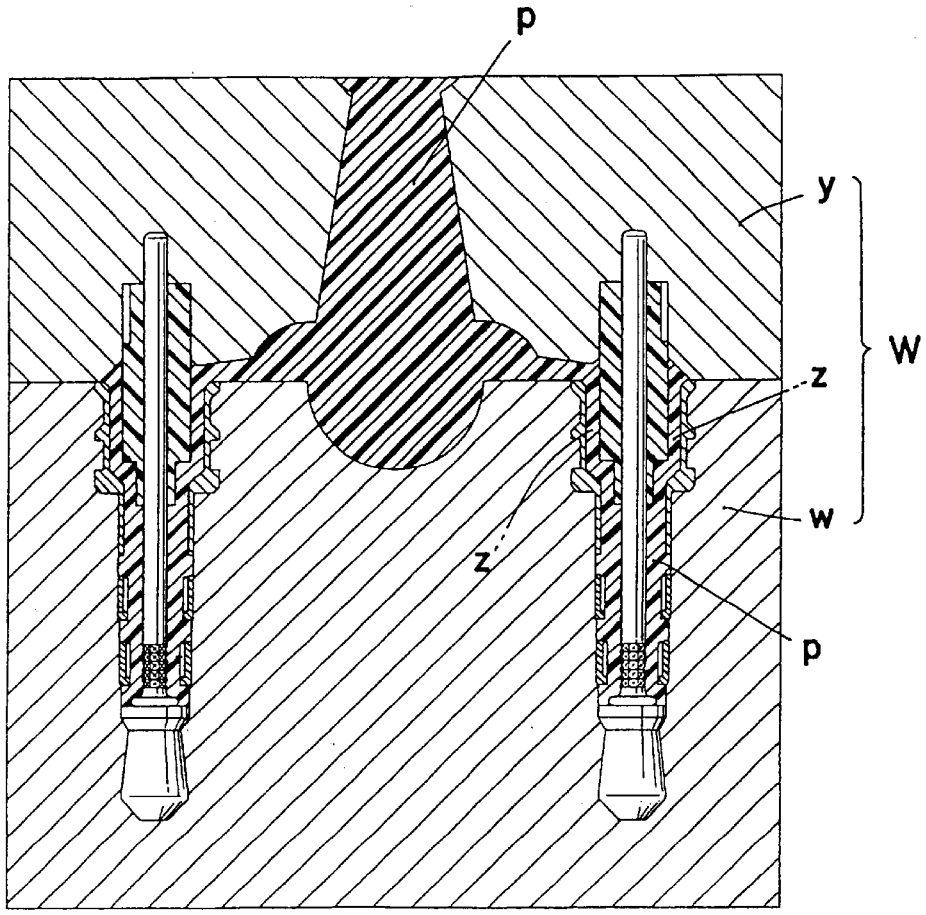
FIG. 29 is a schematic illustration of pressure injection of a resin material into the resin molding in the above state of the above plug.

Accordingly, the resin material p is allowed to flow to each portion through the flow paths z formed on the left and right side surfaces of the resin molding 6 when the pressure-injection of the resin material p into the mold W is carried out as shown in FIG. 29, providing the quadruple-polar coaxial plug as shown in FIG. 7.

Figure 30:
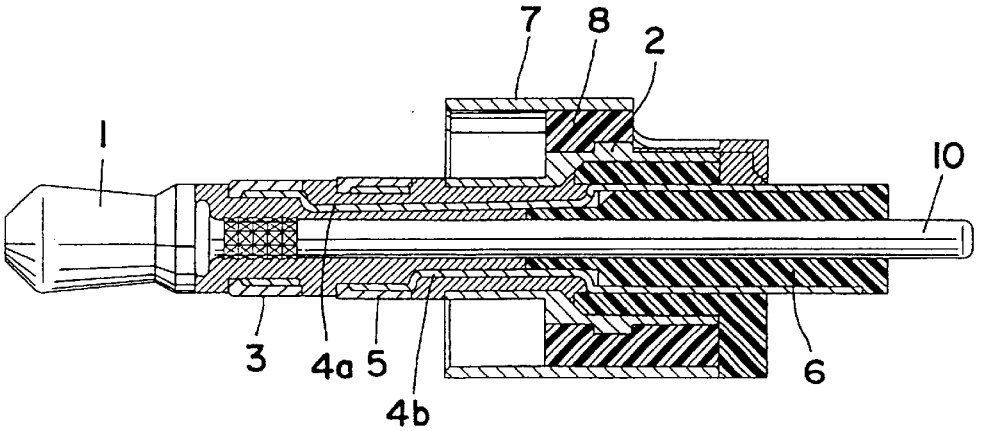
FIG. 30 is a longitudinal sectional side view showing an embodiment of the above plug further mounted with the fifth pole.

Referring now to FIG. 30, there is shown another embodiment of the multi-polar coaxial plug provided with one more pole by fitting an external pole 7 formed in the shape of a large-diameter sleeve to the circumference of the outer sleeve 2 of the quadruple-polar coaxial plug.

Figure 31:
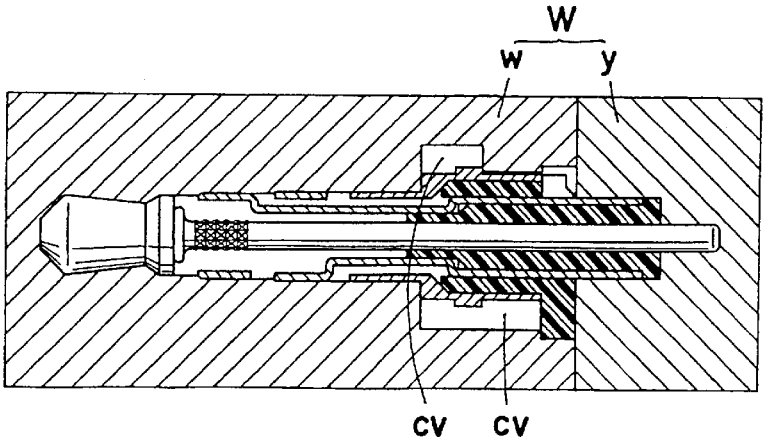
FIG. 31 is a longitudinal sectional view showing the above embodiment at the time of being set in the mold.
Figure 32:
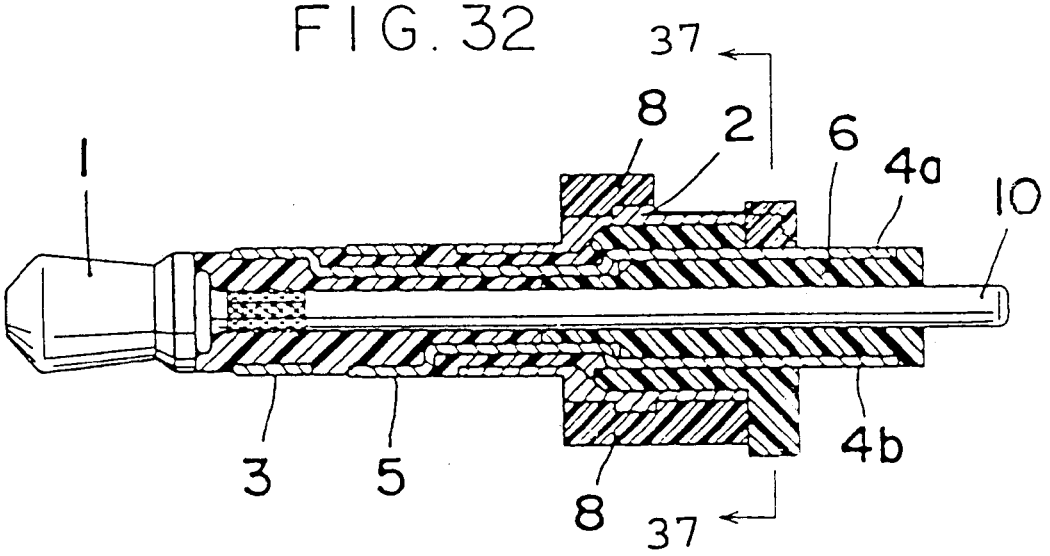
FIG. 32 is a longitudinal sectional side view showing the above embodiment after molding with a resin material.
Figure 37:
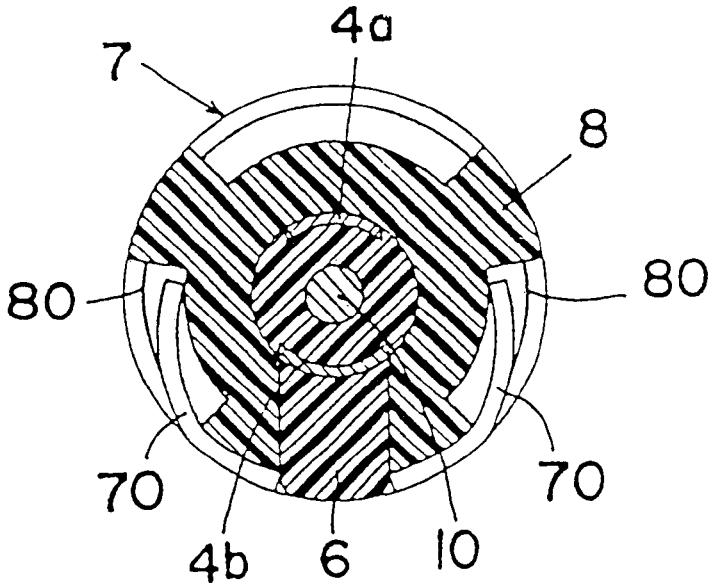
FIG. 37 is a cross-sectional view taken along the line 37—37 in FIG. 32, showing a multi-polar coaxial plug mounted with the above external pole as the fifth pole.

According to the above embodiment, the multi-polar coaxial plug as shown in FIG. 30 is assembled by fitting the separately formed external pole 7 of large-diameter sleeve shape, as the target fifth pole for additional mounting, to the circumference of the fit portion 8 after the end of molding carried out on condition that the draw w of the mold W is formed to have more cavity cv on the inner surface of the existent cavity for molding the fit portion 8, which allows the external pole 7 of large diameter sleeves shape is fitted, with the resin material p as shown in FIG. 31 before the members incorporated in the resin molding 6 in the temporarily fixed state are set in the mold W together with the resin molding 6, and that the fit portion 8 allowing the external pole 7 of large diameter to be fitted is formed on the outer surface of the outer sleeve 2 with the resin material p as shown in FIG. 32 before the resin molding 6 incorporated with the members in the temporarily fixed state are set in the mold W for molding the multi-polar coaxial plug by pressure injection of the resin materiel p.

The external pole 7 of large diameter fitted to the circumference of the outer sleeve 2 after the end of molding is formed by bending a metal sheet, which is punched in a predetermined band-like shape, in a cylindrical shape. The rear end of the external pole has a pair of bent pieces 70, 70 for caulking the external pole 7 to the fit portion 8 in the manner of bending the external pole 7 toward concave portions 80, 80 formed on the fit portion 8 formed on the circumference of the outer sleeve 2 in such a state that the external pole 7 is fitted to the circumference of the fit portion 8.

Accordingly, the separately formed external pole 7 thus fitted provides one more pole for the multi-polar coaxial plug after the end of molding, as shown in FIG. 30.

As has been described in the foregoing, according to the multi-polar coaxial plug by the means of the present invention, in the case of forming the connection terminal pieces, which are connected to the metal rings mounted between the head acting as the first pole and the outer sleeve acting as the second pole to set up third, fourth, . . . nth external poles, to have such a shape as the intermediate sleeve mounted in the radially intermediate portion between the center pin extending from the head and the outer sleeve is divided into a plurality of parts in the circumferential direction, and then setting the connection terminal pieces in the mold for molding in the manner of mounting the connection terminal pieces between the center pin and the outer sleeve in ring-shaped arrangement at predetermined intervals in the circumferential direction as seen from the longitudinal direction, there is only the need for operation of incorporating the connection terminal pieces in the separately formed resin molding in the temporarily fixed state together with the center pin extending from the head and the outer sleeve or the like before setting the members in the mold inclusively of the resin molding. Thus, the operation of setting the members in the mold after location of the members is substantially facilitated, and the members may be set in the mold with accuracy.

What is claimed is:

1. In a multi-polar coaxial plug comprising:

plug components including a head; a center pin integrally connected with a rear end side of said head; an outer cylindrical sleeve to be coaxially fitted around an outer periphery of said center pin; a plurality of metal rings positioned between a front face side of said outer cylindrical sleeve and a rear face side of said head and to be coaxially fitted on and around the outer periphery of said center pin in a longitudinally parallel relationship; and a plurality of metal connection terminal pieces extending from said metal rings in an integral manner or through intermediary members to provide a unit of a plug assembly, said unit of a plug assembly being adapted to be set in a cavity of a metal mold with said plug components at predetermined positions in said metal mold, the improvement which comprises: a shaped body formed of a resin material, said shaped body having an axially extending center bore to permit said center pin extending from the rear end side of said head to be fittingly inserted thereinto, said shaped body also having, on its outer peripheral surface, a fitting surface to be fitted within the outer cylindrical sleeve, and said shaped body further having formed, at an intermediate radial part between said fitting surface and said center bore, through-holes for fittingly inserting into each one thereof one of said plurality of connection terminal pieces to be connected with a plurality of metal rings positioned between the front end face of said outer cylindrical sleeve and said rear end face of said head, and wherein said shaped body is provided with a flow-path (z) adjacent said outer cylindrical sleeve, to permit flow of resin material to be injected under pressure, in a manner to be disposed in an annular form with a predetermined space interval in the circumferential direction, as viewed from the rear face, of said shaped body, a rear end side of said center pin extending from said head, the outer cylindrical sleeve, the shaped body, and rear end sides of said plurality of connection terminal pieces being assembled together in an intermediate fixed assembly, said plug being formed by setting said intermediate fixed assembly in the metal mold, and molding the same with use of the resin material in an integral structure.

2. A multi-polar coaxial plug according to claim 1, wherein said through-holes formed in the intermediate parts of said resin shaped body in its radial direction have different sectional shapes to allow the connection terminal pieces to be fittingly inserted thereinto, and said connection terminal pieces to be fittingly inserted into said through-holes are each formed to have a shape conforming to said individual through-hole.

3. In a method for assembling and molding a multi-polar coaxial plug, which comprises: assembling a plurality of metal rings in a longitudinally parallel relationship between a rear face of a head at a front end to constitute a first pole, and a front face of an outer cylindrical sleeve to be coaxially fitted on an outer periphery of a center pin extending from the rear face of said head to constitute a second pole, said plurality of metal rings serving as third, fourth, . . . and n'th poles; then forming connection terminal pieces to be connected integrally or through intermediary members to each of said metal rings, between the outer periphery of said center pin and an inner peripheral surface of said outer cylindrical sleeve, with the connection terminal pieces being coaxially positioned in a circumferential direction; and mold-forming said assembled metal rings with use of a resin material, in which said connection terminal pieces are disposed in a spaced apart annular form circumferentially between said center pin and said outer cylindrical sleeve, the improvement wherein said method comprises:

providing a resin body having a center bore into which said center pin is fittingly inserted at its center position, a through-hole being defined around said center bore to permit said connection terminal pieces to be fittingly inserted around said center bore, said resin body further having on an outer peripheral surface thereof on and around which said outer cylindrical sleeve is fitted, a flow-path (z) to permit passage therethrough of resin material to be injected under pressure, said flow-path (z) being located along said resin body and within the inner peripheral surface of said outer cylindrical sleeve;

fittingly providing and assembling in an intermediate fixed assembly said center pin, said plurality of connection terminal pieces, and said outer cylindrical sleeve, respectively in said center bore, in said through-hole, and about said outer peripheral surface of said resin shaped body; and followed by setting said intermediate fixed assembly into a metal mold to form the same with said injected resin material.

4. A method for assembling and molding a multi-polar coaxial plug in an assembled state according to claim 3, wherein when said center pin extending from said head, said outer cylindrical sleeve, and said connection terminal pieces to be connected to said metal rings are assembled to said resin shaped body in a temporarily fixed state, and then set in the metal mold, to be integrally molded with use of the resin material, a fitting part, on which a separately formed cylindrical outer pole is fittingly mounted, is formed on the outer peripheral side of said outer cylindrical sleeve with use of said resin material.

* * * * *